United States Patent [19]

Yamamoto et al.

[11] Patent Number: 4,745,654

[45] Date of Patent: May 24, 1988

[54] HAND-HELD VACUUM CLEANER

[75] Inventors: Kyoichi Yamamoto; Syouiti Tohya, both of Sumoto, Japan

[73] Assignee: Sanyo Electric Co., Ltd., Japan

[21] Appl. No.: 886,183

[22] Filed: Jul. 16, 1986

[30] Foreign Application Priority Data

Aug. 8, 1985 [JP] Japan ..... 60-174674
Oct. 9, 1985 [JP] Japan ..... 60-154474

[51] Int. Cl.[4] ..... A47L 5/24

[52] U.S. Cl. ..... 15/344; 15/347; 15/352; 55/473; 55/482

[58] Field of Search ..... 15/344, 347, 352; 55/372, 473, 482, DIG. 3

[56] References Cited

U.S. PATENT DOCUMENTS 3,172,743 3/1965 Kowalewski ..... 55/473
3,914,820 10/1975 Hankel ..... 15/352
4,426,211 1/1984 Ataka et al. ..... 15/352
4,458,377 7/1984 Frohbieter ..... 15/321
4,463,472 8/1984 Uibel ..... 15/327 F
4,545,794 10/1985 Himukai ..... 55/482
4,577,365 3/1986 Yuen ..... 15/344
4,644,605 2/1987 Joss et al. ..... 15/352

*Primary Examiner*—Peter Feldman
*Assistant Examiner*—Corinne Reincken
*Attorney, Agent, or Firm*—Darby & Darby

[57] ABSTRACT

A hand-held vacuum cleaner comprising a dust case having an upward opening and an air-permeable filter wall formed as at least a portion of its structural wall, the dust case being removably fitted in a dust collecting recess formed in the main body of the cleaner, a partitioning member having a suction opening and removably fitted over the opening of the dust case to cover the opening, and a closure pivoted to the cleaner main body and openably closing the opening of the recess except the suction opening of the partitioning member. A paper filter can be held between the dust case and the partitioning member.

10 Claims, 5 Drawing Sheets

HAND-HELD VACUUM CLEANER

FIELD OF THE INVENTION

The present invention relates to a hand-held electric vacuum cleaner, and more particularly to such a cleaner which is suited to clean places of small space or a special place remote from wall outlets rather than entirely clean rooms or wide places.

RELATED ART STATEMENT

Unexamined Japanese Utility Model Publication SHO No. 58-160555, for example, discloses a cordless hand-held vacuum cleaner of the above-mentioned type which comprises a dust case attached to the front of its main body and having a specific filter device therein. The cleaner is inconvenient to handle since the filter device needs to be cleaned every time dirt is discarded, while the cleaner requires the filter device which is specifically designed therefor.

Accordingly, one of the present inventors has already proposed a hand-held vacuum cleaner adapted for use with a paper filter, such as tissue paper or kitchen paper, which is inexpensive and readily available (see Japanese Utility Model Application SHO No. 59-168191). This cleaner is provided with a dust collecting recess formed in the front portion of its main body and having an upward opening. A paper filter is placed into the recess, which is then closed over the paper filter with a closure having a suction opening. Thus, dirt can be collected in the recess by the filter. The collected dirt can be discarded easily along with the filter by removing from the recess the paper filter with the accumulation of dirt thereon.

Although the vacuum cleaner is thus made easy to handle, the cleaner still has the problem that the dirt once collected is liable to spill when it is to be discarded. Stated more specifically, the closure must be opened first before the paper filter is removed from the recess with the dirt collected thereon. However, when the closure is opened, the dirt collecting portion of the paper filter is exposed to readily permit spilling of the dirt, while the exposed dirt collecting portion is urged by the opening of the closure to release the dirt easily.

Another problem is encountered with the hand-held vacuum cleaner for which a paper filter is usable. FIG. 6 shows such a cleaner which has a dust collecting recess 40 formed in the front portion of its main body, a closure 41 for the recess and a paper filter 42 provided between the recessed portion and the closure. The cleaner has the drawback that the margin 42*a* of the paper filter 42 fitted in place is left projecting from the closure 41, is therefore unsightly and is likely to become soiled or broken.

SUMMARY OF THE INVENTION

The present invention provides a hand-held vacuum cleaner comprising a main body provided with a dust collecting recess in its front portion, an air outlet communicating with the recess and a handle, the dust collecting recess having an upward opening; a dust case having an upward opening and an air-permeable filter wall formed as at least a portion of its structural wall, the dust case being removably fitted in the dust collecting recess; a partitioning member having a suction opening and removably fitted over the opening of the dust case to cover the opening; a closure pivoted to the main body and openably closing the opening of the dust collecting recess except the suction opening of the partitioning member; a fan motor housed in the main body for taking in outside air through the suction opening and discharging the air from the air outlet at least through the filter wall; and means for supplying electric power to the fan motor.

According to the present invention, the partitioning member provided for removably covering the upward opening of the dust case makes it possible to remove the dust case first in a closed state from the dust collecting recess of the main body (irrespective of whether a paper filter is used or not), so that the collected dirt can be carried, as confined in the compacted case, to a location very close to the place of dirt disposal without being released from the case before approaching the place of disposal. Thus, the present invention precludes spilling of dirt when the cleaner is emptied of dirt and assures facilitated disposal of dirt.

Further when the vacuum cleaner of the present invention has paper holding ribs formed on the partitioning member which is more specifically a filter holder, a paper filter can be held between the holder and the dust case, as extended over the inside surface of the dust case by the holder, especially by the paper holding ribs thereof, consequently affording a wide dust collecting space. Moreover, if the margin of the paper filter projects upward outside the filter holder, the margin is folded over, and the upward opening of the dust collecting recess is then closed with the closure. The margin of the filter is therefore covered with the closure without projecting out. The dust or dirt drawn in through the suction opening accumulates on the filter paper and can be discarded along with the filter.

DESCRIPTION OF THE PREFERRED EMBODIMENTS

Figure 1:
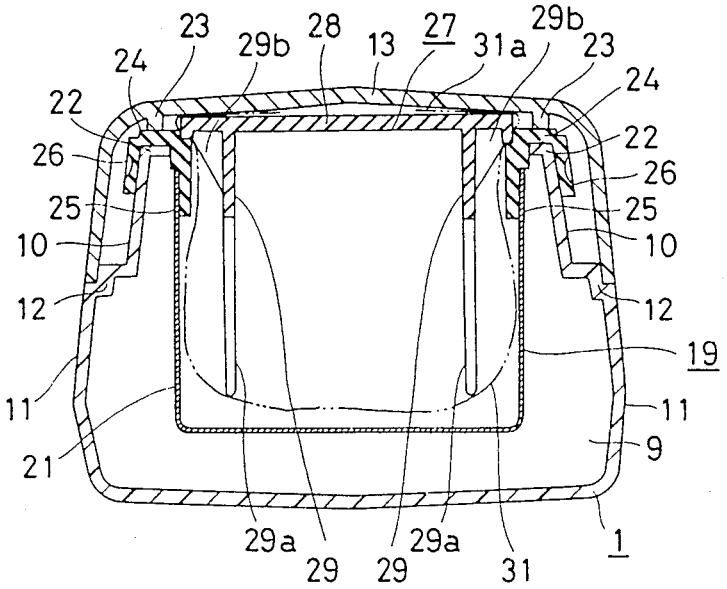
FIG. 1 is a view in cross section showing a hand-held vacuum cleaner embodying the present invention.
Figure 2:
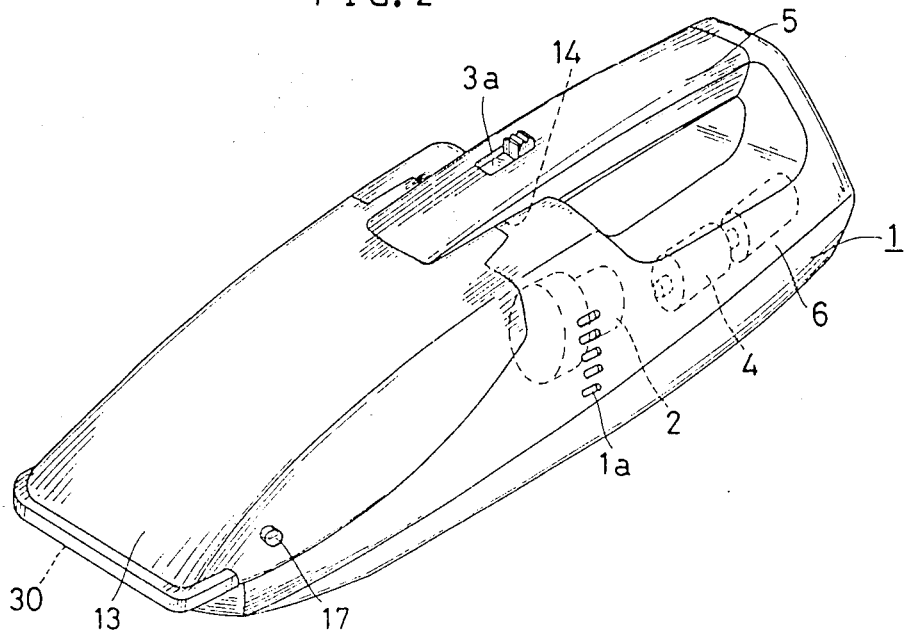
FIG. 2 is a perspective view showing the same.
Figure 3:
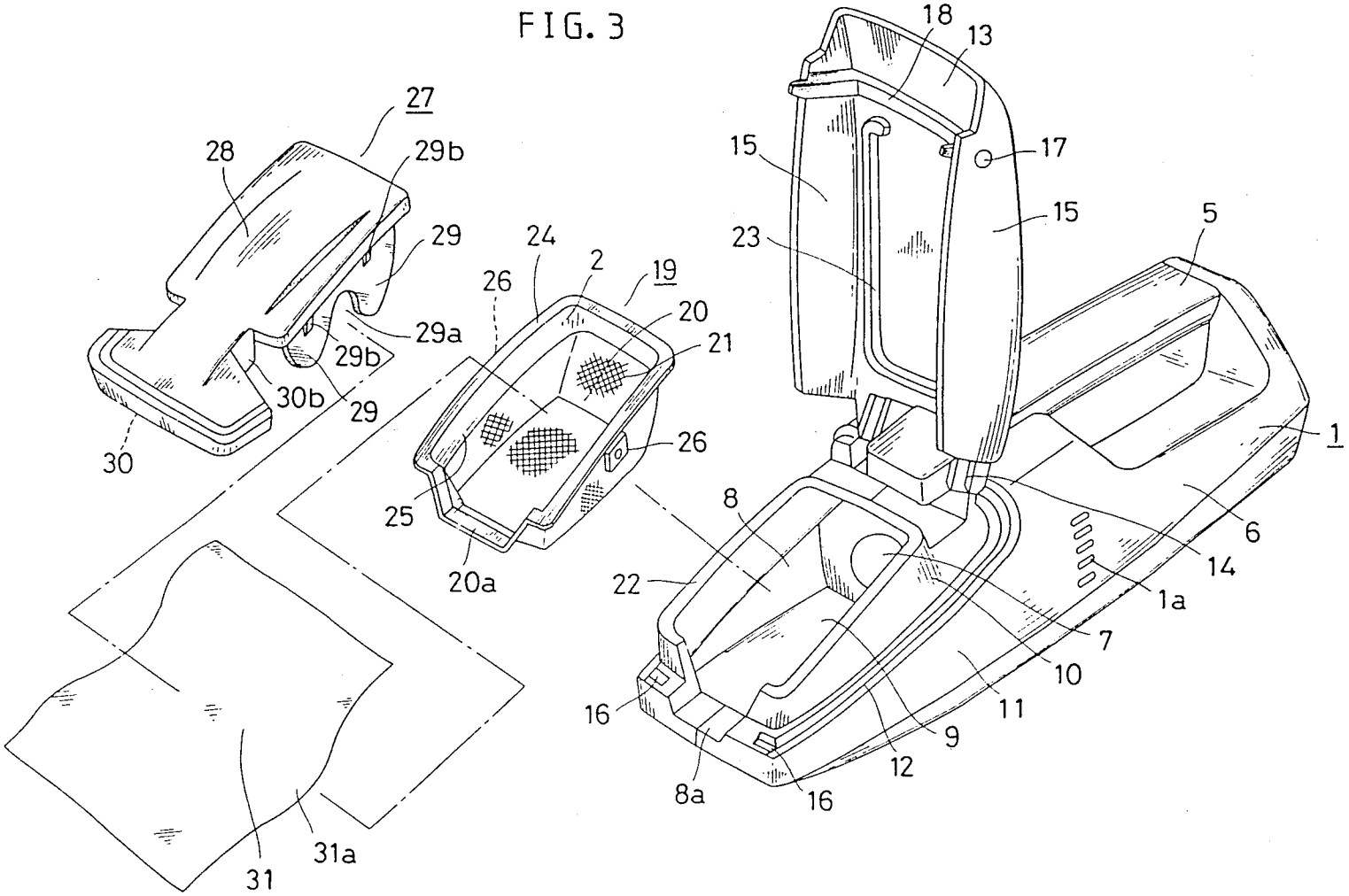
FIG. 3 is an exploded perspective view showing the same with its closure left open.
Figure 4:
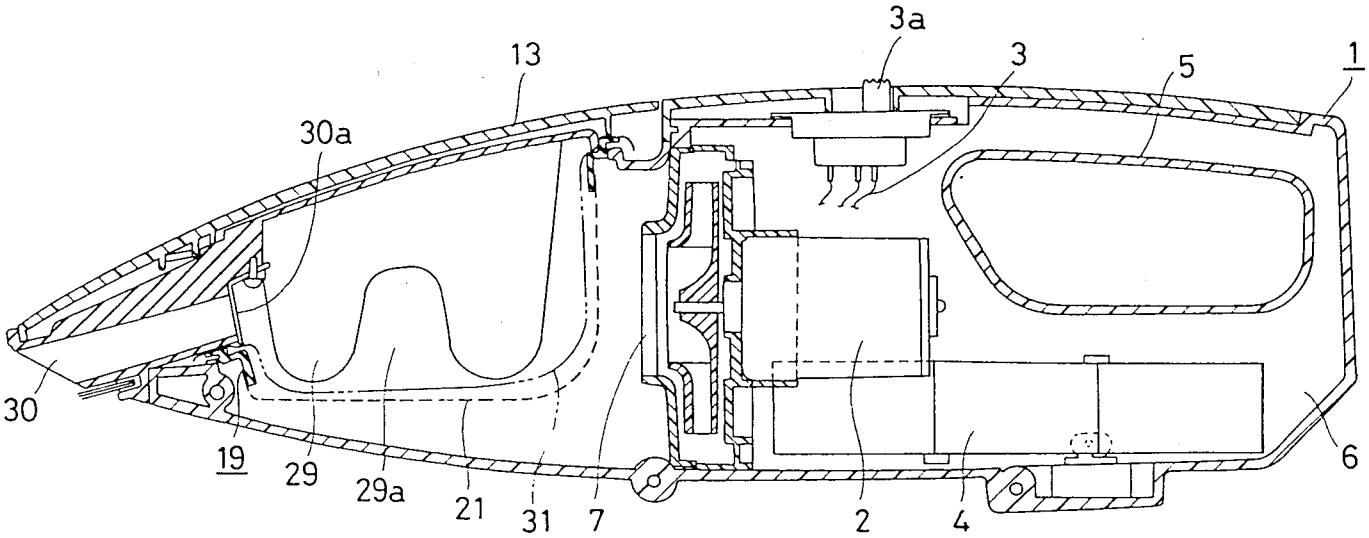
FIG. 4 is a view in longitudinal section showing the same.

With reference to FIGS. 1 to 4 first, the main body 1 of a hand-held electric vacuum cleaner has at its reverse portion a device accommodating portion 6 housing a fan motor 2, a power supply switch 3*a*, rechargeable batteries 4 and like electric devices and provided with a handle 5. The main body 1 is formed in its front portion with a dust collecting recess 9 communicating with the device accommodating portion 6 through a suction opening 7 and having an upward opening 8. The recessed portion has a first opening 8*a* at its front end for a suction opening member to fit in. The recess 9 is defined by an upper side wall 10 and a lower side wall 11, the former being positioned inwardly of the latter toward the center of the recess 9. The junction between the upper and lower side walls 10 and 11 is stepped and formed with a groove 12 for a closure 13 to engage in.

Indicated at 1*a* are air discharge ports, and at 3 is a power supply circuit including the switch 3*a*.

The closure 13 for openably closing the upward opening 8 of the dust collecting recess 9 is pivotably attached by hinge means 14 to the wall of the main body 1 above the suction opening 7 in the main body 1. The closure 13 has opposite side plates 15 downwardly extending from its top plate for covering the uppwer side wall 10 with their lower ends engaged in the groove 12 when the closure 13 closes the upward opening 8. The closure 13 is provided with a generally inverted U-shaped latch member 18 of synthetic resin engaging in latch holes 16 in the main body 1 at all times when the closure 13 is in its closed position to hold the closure closed. When a button 17 projecting outward from the side plate 15 is depressed, the latch member 18 is released from the hole 16 by being bent to make the closure 13 openable.

A dust case 19, which is removably fitted in the recess 9, has an upward opening 20 and is formed at its front end with a second opening 20*a* for the suction opening member to fit in. The dust case 19 comprises a box-shaped mesh filter portion 21 accommodated in the recess 9 and spaced from the inner surface of the recessed portion, and a packing frame 24 of flexible synthetic resin generally identical in configuration with the upward opening edge 22 of the recessed portion 9. When the closure 13 is closed, the packing frame 24 is pressed on by a ridge 23 on the closure 13 and held between the opening edge 22 and the closure 13. The packing frame 24 has on its inner side a ring-like downward extension 25 extending into the recess 9 inside the opening edge 22 and having the opening edge of the mesh filter portion 21 attached thereto. Lugs 26, 26 are provided on the outer side of the packing frame 24 at opposite side portions thereof. When the dust case 19 is placed in the dust collecting recess 9, each of the lugs 26 is positioned outside the upward opening edge 22, held between the upper side wall 10 and the downward extension 18 of the closure 13 and covered with the closure 13. Accordingly, the lugs 26 hold the packing frame 24 accurately in position over the opening edge 22, consequently holding the dust case 19 in place within the recess 9 without allowing deformation of the case. Further the dust case 19 can be withdrawn from the recess 9 by pulling out the lugs 26 with fingers.

The dust case 19 is provided with a filter holder 27 serving as a partitioning member. The filter holder 27 comprises a base plate 28 covering the upward opening 20 of the dust case 19 and a pair of paper holding ribs 29, 29 extending from the reverse side of the base plate 28 downward into the dust case 19 and also extending longitudinally of the cleaner. Each of the paper holding ribs 29 is formed with an upward cutout 29*a* in the lower end of its midportion for passing suction air therethrough. Guide ribs 29*b* extend from the base plate 28 of the filter holder 27 and are integral with the paper holding ribs 29. The guide rib 29*b* has an inclined outer surface and reinforces the junction between the paper holding rib 29 and the base plate 28. When the filter holder 27 is fitted into the dust case 19, the guide ribs 29 guide the holder 27 by the contact of their outer surfaces with the packing frame 24 of the dust case 19, whereby the holder 27 can be placed in position within the dust case 19. The base plate 28 extends forward beyond the first and second openings 8*a* and 20*a* to provide at its forward end a tubular opening member having a suction opening 30 for admitting dust or dirt into the dust case 19. The outlet end of the suction opening member opposite to the opening 30 is covered with a flapper valve 30*a* of synthetic rubber. The suction opening member has a constricted portion 30*b* fitting in the first and second openings 8*a*, 20*a*.

Commercial tissue paper or kitchen paper is utilized as it is as a paper filter 31. The paper filter 31 can be placed into the dust case 19 fitted in the recess 9 and held between the filter holder 27 and the case 19 by placing the central portion of the filter 31 over the upward opening 20 of the dust case 19 and then fitting the filter holder 27 into the dust case 19. When thus set in place, the paper filter 31 has its central portion extended over the interior surface of the dust case 19 by the paper holding ribs 29 of the holder 27, providing a wide dust collecting space. The margin 31*a* of the paper filter 31 is folded over the surface of the base plate 28 of the filter holder 27, and the closure 13 is closed, whereby the margin 31*a* of the filter is held between the holder 27 and the closure 13 and hidden from view.

When the power supply switch 3*a* is turned on with the handle 5 grasped by hand, the rechargeable power supply batteries 4 drive the fan motor 2. Accordingly, dirt is drawn into the dust case 19 through the suction opening 30 and collected by the paper filter 31. At this time, the paper filter 31 is held in intimate contact with the inner side of the dust case 19, retained in shape by the case 19 and thereby protected from breaking. Because there is a space in the dust collecting recess 9 around the dust case 19, i.e., between the outer peripheral surface of the mesh filter portion 21 of the case 19 and the inner surface of the main body 1 defining the recess 9, and further because the air drawn in flows also through the cutouts 29*a* in the paper holding ribs 29 and then through the side portions of the case 19, a wrde filtering area is available. Since the dirt drawn in passes through the air passing cutouts 29*a* and accumulates also on opposite side portions of the paper filter 31, dirt can be trapped efficiently by the paper filter 31 over the entire surface thereof. Accordingly, the cleaner gets a larger dirt-collecting capacity, so that this reduces the number of times dirt is to be discarded.

For the discard of the dirt, the closure 13 is turned open, the margin 31*a* of the paper filter 31 is unfolded, the filter holder 27 is removed, the paper filter 31 is further removed with the dirt accumulated thereon by holding the marging 31*a* with hand, and the paper filter and dirt are discarded.

The dust case 19 can be fitted into the recess 9 accurately in position, with the lugs 26 positioned outside the upper opening edge 22 of the recessed portion 9, merely by placing the dust case 19 into the recess 9. Further the packing frame 24 enables the closure 13 to close the dust case 19 effectively. Because of these features, the present cleaner achieves a high dirt collecting efficiency. For the disposal of dirt, the dust case 19 is readily removable from the dust collecting recess 9 by pulling out the lugs 26 with fingers.

The present vacuum cleaner is operable for cleaning even when no paper filter is used. In this case, the dirt drawn in through the suction opening 30 can be trapped by the mesh filter portion 21 of the dust case 19 serving as a filter wall. When a large amount of dirt has been collected in the dust case 19, the case 19 is removed from the main body 1, carried to a suitable place of dirt disposal and emptied of the dirt as in the case where the paper filter 31 is used. Since the upward opening 20 of the dust case 19 is held closed with the filter holder 27, the dust case 19 can be removed and carried without spilling the dirt. The dirt is therefore disposable with great ease.

Also when the paper filter 31 is used, dirt can of course be discarded along with the filter by removing the dust case 19 from the main body 1 first with the filter holder 27 attached to the case and thereafter removing the filter holder 27 therefrom at the place of dirt disposal. Thus, the dirt is readily disposable without spilling.

Figure 5A:
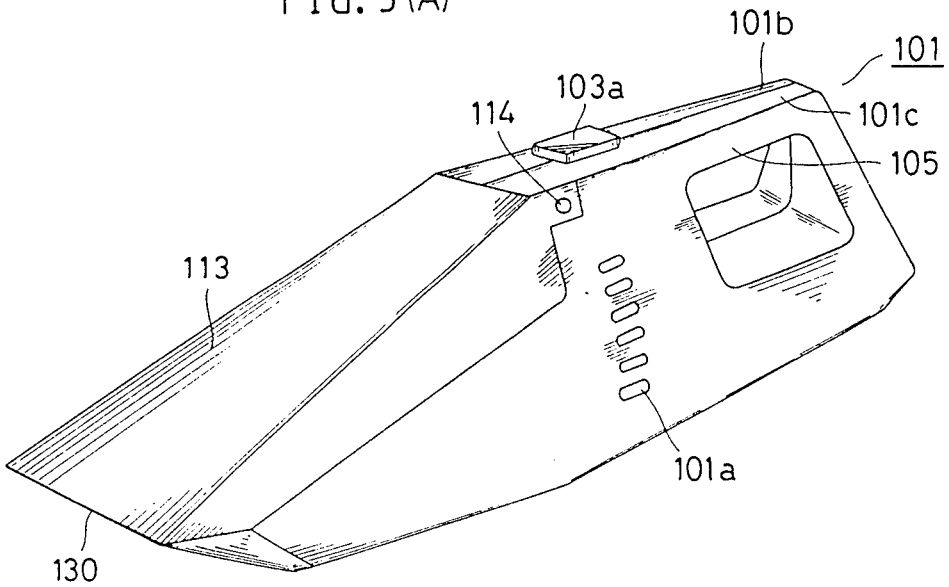
FIGS. 5(A) and 5(B) are a perspective view and a view in longitudinal section, respectively, showing another embodiment.
Figure 5B:
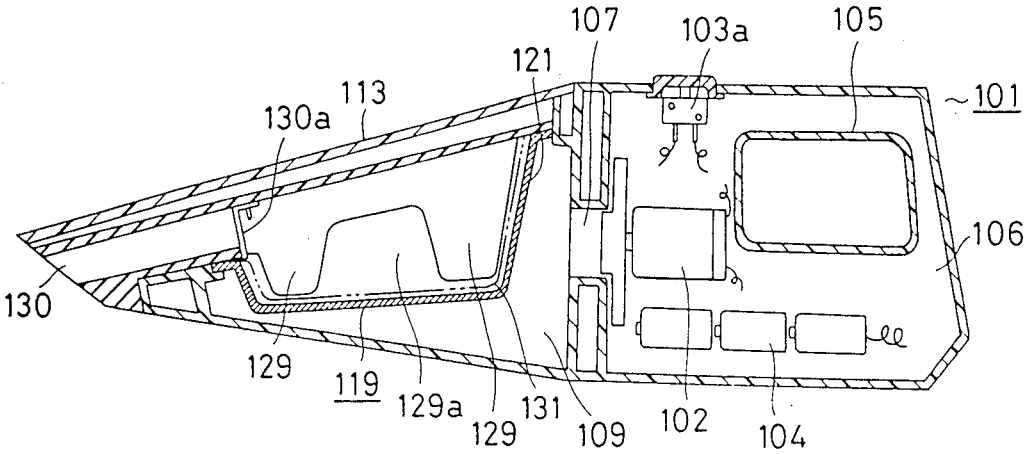
Figure 6:
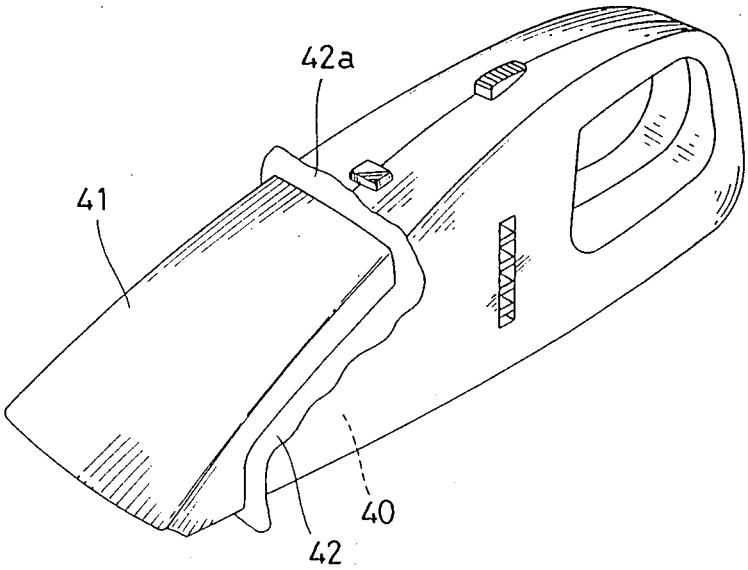
FIG. 6 is a perspective view showing a cleaner already proposed by the present applicant.

FIGS. 5(A) and 5(B) show another embodiment of the invention. Each of the parts corresponding to those of the first embodiment is designated by the same corresponding reference number plus 100.

What is claimed is:

1. A hand-held vacuum cleaner, comprising a main body having a dust collecting recess in a front portion thereof, an air outlet communicating with the recess, said dust collecting recess having an upward opening, a handle, a dust case having an upward opening and an air-permeable filter wall formed as at least a portion of its structural wall, the dust case being removably fitted within the dust collecting recess, a partitioning member having a suction opening and removably fitted over the opening of the dust case to cover the opening, a closure pivoted to the main body for opening and closing the opening of the dust collecting recess except the suction opening of the partitioning member, a fan motor positioned in the main body for drawing in outside air through the suction opening and discharging the air from the air outlet at least through the filter wall, means for supplying electric power to the fan motor, said partitioning member comprising a base plate removably fitted over the upward opening of the dust case for covering the opening and for holding a thin filter between the base plate and the dust case, and the base plate having the suction opening and ribs extending longitudinally of the vacuum cleaner and downwardly from its reverse side to substantially an inside surface of the dust case for contacting and pushing the thin filter into the dust case.

2. A hand-held vacuum cleaner as defined in claim 1 wherein the partitioning member comprises a base plate removably fitted over the upward opening of the dust case to cover the opening, and the base plate has the suction opening and ribs extending downward from its reverse side.

3. A hand-held vacuum cleaner as defined in claim 1 wherein each of the ribs of the partitioning member has a cutout for passing therethrough the outside air drawn in.

4. A hand-held vacuum cleaner as defined in claim 1 wherein the dust case is provided at its opening peripheral edge with a packing frame clamped between the opening peripheral edge of the dust collecting recessed portion and the closure.

5. A hand-held vacuum cleaner as defined in claim 4 wherein the packing frame has positioning lugs extending outward therefrom over the opening peripheral edge of the dust collecting recessed portion.

6. A hand-held vacuum cleaner as defined in claim 5 wherein the closure has a side plate downwardly extending from its side edge, and the positioning lug of the packing frame is held between the side plate and the opening peripheral edge of the dust collecting recessed portion.

7. A hand-held vacuum cleaner as defined in claim 1 wherein the power supplying means comprises a power supply battery housed in a reverse portion of the main body and a power supply circuit for supplying electric power from the battery to the fan motor via a power supply switch.

8. A hand-held vacuum cleaner as defined in claim 7 wherein the power supply battery is a rechargeable battery.

9. A hand-held vacuum cleaner according to claim 1 wherein the thin sheet filter is a sheet paper filter.

10. A hand-held vacuum cleaner as defined in claim 9 wherein the paper filter is tissue paper or kitchen paper.

* * * * *